United States Patent [19]

Derichs

[11] Patent Number: 4,682,636

[45] Date of Patent: Jul. 28, 1987

[54] METHOD AND DEVICE FOR PRODUCING A TEXTILE WEB BY PNEUMATIC WEFT PICKING OR INSERTION

[75] Inventor: Josef Derichs, Monchen-Gladbach, Fed. Rep. of Germany

[73] Assignee: W. Schlafhorst & Co., Monchen-Gladbach, Fed. Rep. of Germany

[21] Appl. No.: 761,612

[22] Filed: Aug. 1, 1985

[30] Foreign Application Priority Data

Aug. 1, 1984 [DE] Fed. Rep. of Germany ..... 3428387

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,181,571 | 5/1965 | Scheffel | 139/435 |
| 4,102,361 | 7/1978 | Tanaka et al. | 139/435 |
| 4,143,681 | 3/1979 | Kuda et al. | 139/435 |
| 4,328,842 | 5/1982 | Scheffel | 139/435 |

FOREIGN PATENT DOCUMENTS

| | | | |
|---|---|---|---|
| 49-24186 | 6/1974 | Japan | 139/435 |

*Primary Examiner*—Henry S. Jaudon

*Attorney, Agent, or Firm*—Herbert L. Lerner; Laurence A. Greenberg

[57] ABSTRACT

Method of producing a textile web by pneumatic weft picking includes bringing a weft thread in contact with flowing hot air during the insertion of the weft thread; and device for performing the method.

10 Claims, 4 Drawing Figures

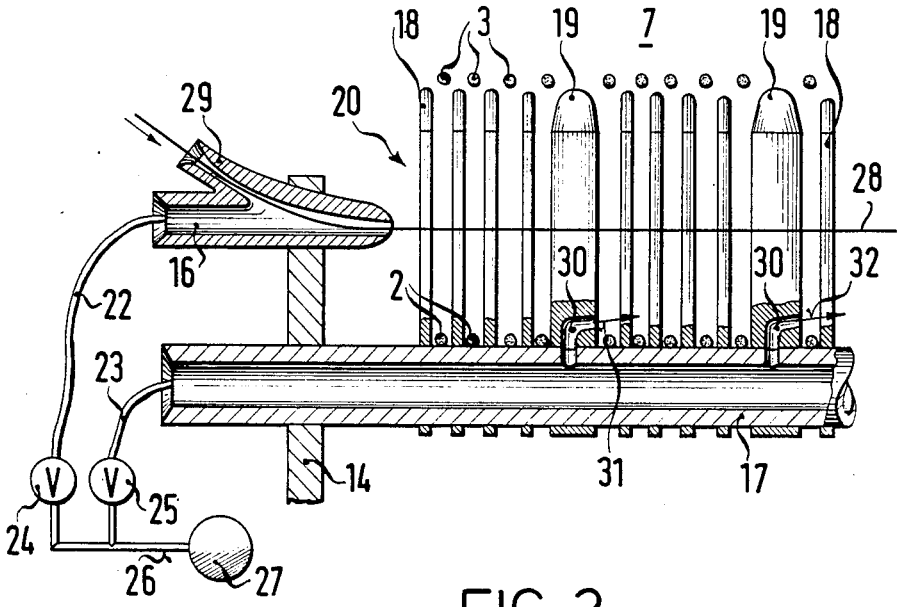
FIG. 2
FIG. 3
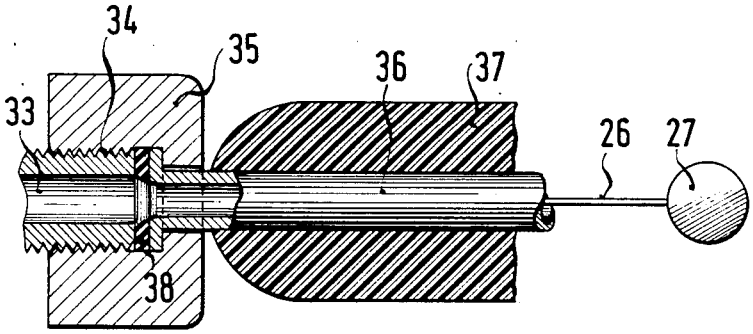

METHOD AND DEVICE FOR PRODUCING A TEXTILE WEB BY PNEUMATIC WEFT PICKING OR INSERTION

The invention relates to a method and device for producing a textile web by pneumatic weft picking or insertion.

Pneumatic weft picking as conventional in weaving machines or looms for example. In knitting machines, also, weft threads can be picked or inserted pneumatically, if desired. A knitted fabric or cloth is then formed which is reinforced by weft threads.

The speed and quality of the weft picking and the required energy therefor depend on various factors of which the type, the structure, and the roughness of the thread-material used for making the textile web or fabric are most important. These factors which must be accepted as given parameters, impose limits upon the quality, and the speed with which the fabric or textile web can be produced.

It is accordingly an object of the invention to provide an improved method and device for producing a textile web or fabric by pneumatic weft picking or insertion, especially with regard to the quality of the finished textile web or fabric, the rate at which it can be produced, and as much as possible also with respect to energy conservation in the production process.

With the foregoing and other objects in view, there is provided, in accordance with the invention, a method of producing a textile web by pneumatic weft insertion which includes bringing a weft thread in contact with flowing hot air during the insertion of the weft thread.

In the case of a weaving process, in accordance with the invention, the weft thread is inserted or introduced by flowing hot air into the shed formed by warp threads.

By means of the heated air, the fiber material is briefly heated, and thereby made pliable for the insertion or picking of the weft thread, and for binding the latter into the textile, web, without incurring disadvantageous drying or embrittlement during the brief period. The weft thread slides better and faster through the shed, remains stretched better, and, if desired, is bound, while yet in heated state, into the textile web or fabric.

The flowing hot air can inject the weft thread into the shed, and, under certain conditions, can also transport it through the entire shed.

In accordance with another mode according to the invention, the method includes successively seizing, carrying and transporting a weft thread forward by a plurality of hot gas flows during the picking of the weft thread. This is especially advantageous for wide webs or sheets.

In accordance with further modes of the invention, the air is heated to at least 45° C., and at most 120° C. and, alternatively, to a temperature of from 60° to 80° C. Preferred temperature ranges are thereby defined. In practice, the heated air temperature is adjusted with respect to the selected air pressure, the type of web picking arrangement, the production rate, and diameter and the yarn number, respectively, of the weft thread and, most of all, the type of fiber material. Natural fibers having a cellulose base can, in general, tolerate higher temperatures than wool or synthetic fibers.

In accordance with another aspect of the invention, there is provided a textile web by pneumatic weft picking, including a weft picking device connected to a hot air generator.

If a loom is used for producing the textile web or fabric, the weft filling device has at least one weft picking or injection nozzle operated by hot air and arranged at the side of at least one open shed.

In accordance with a further feature of the invention, the weft insertion device, which is connected to the hot air generator, has a plurality of nozzles for carrying and/or accelerating a weft thread in a forward transporting direction, those nozzles being arranged at least along one shed and being operated by hot air.

The invention affords at least the following operating modes: The weft thread can be inserted into the shed in any suitable manner, and thereafter brought into contact with hot air, which flows out of the carrying nozzles. In an alternative mode of operation, the weft thread is pneumatically inserted directly by either hot or cold air, and is then also, during the insertion step, brought into contact with hot air which originates from the respective carrying and accelerating nozzles. The weft thread can also be inserted by hot air without additionally providing carrying and/or accelerating nozzles.

As a measure for saving energy, in accordance with yet a further feature of the invention, the hot air generator is constructed as an air compressor. As is generally known, an air compressor heats the air by compression when producing the compressed air. The air which, by compression, has been heated to a sufficient temperature without requiring any additional measures, is conducted, in accordance with a concomitant feature of the invention, to the weft insertion device with minimum heat loss by a heat-insulated pipeline mutually connecting the weft insertion device and the hot air generator.

Other features which are considered as characteristic for the invention are set forth in the appended claims.

Although the invention is illustrated and described herein as embodied in method and device for producing a textile web by pneumatic weft insertion or picking, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

FIG. 2 is a longitudinal sectional view of part of the pneumatic weft insertion or picking device;

FIG. 3 is an enlarged fragmentary sectional view of FIG. 2 showing an operative connection between a hot air generator and one of the valves in the lines connected to the weft insertion or picking device according to the invention.

Figure 1:
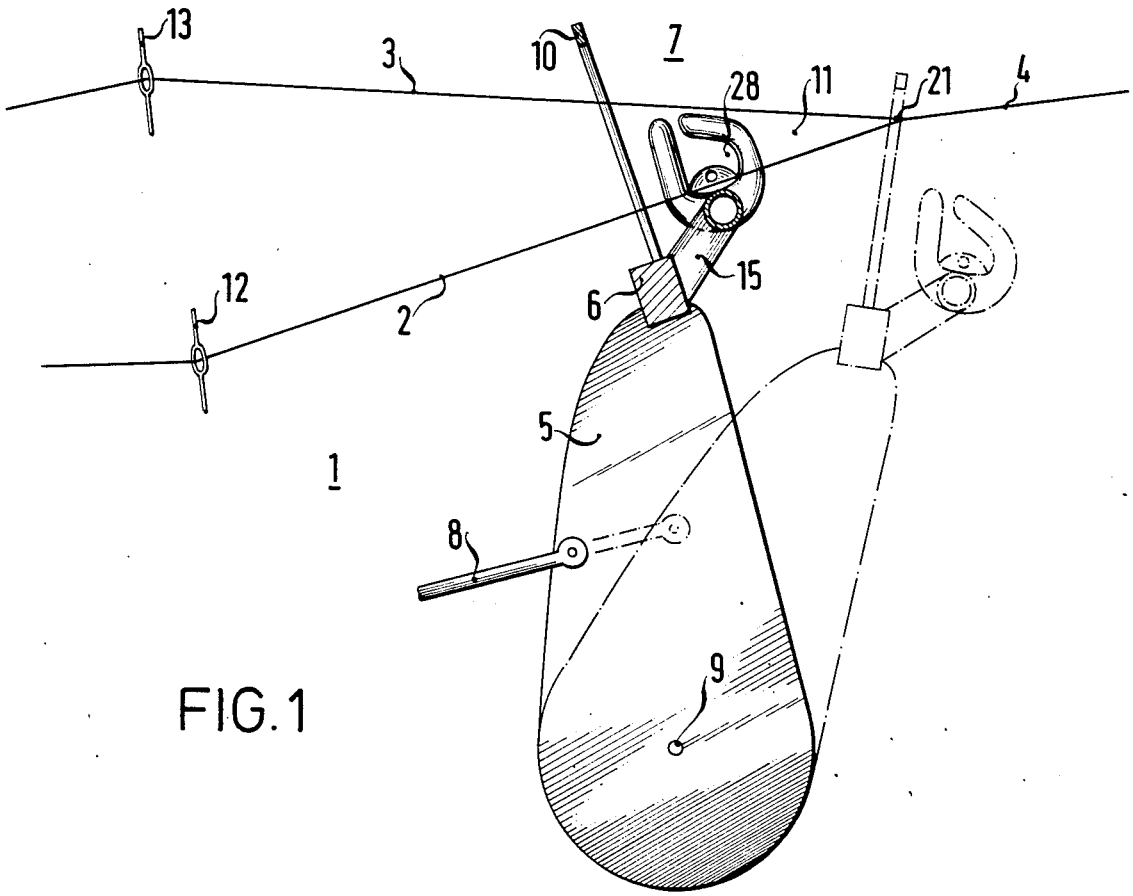
FIG. 1 is a diagrammatic side elevational view of a pneumatic weft insertion or weft picking device.

Referring now to the drawing and first, particularly, to FIG. 1 thereof, there is shown, in a weaving machine or loom 1, only partly illustrated in FIG. 1, a textile sheet in the form of a web or woven fabric or cloth 4 produced from warp threads 2 and 3 by pneumatic weft picking or insertion. A weaving lay 6 carries the pneumatic weft picking device identified as a whole by reference numeral 7. By means of a connecting rod 8 the weaving lay 6 can be swung around a pivot axis 9 from the weft picking position shown in FIG. 1 into a stop position shown in phantom therein. The weaving lay 6 carries a reed 10, between the laminations, strips or wires 18 thereof (see FIG. 2), the warp threads 2 and 3 of the thread groups forming a weaving shed 11 lie.

Alternatingly upwardly swingable heddles 12 and 13 guide the warp threads 2, 3, and serve to form the weaving shed 11.

The pneumatic weft picking device 7 is connected by traverses 14, 15 with the weaving lay 6. According to FIG. 2, the weft picking device 7 is provided with a weft picking nozzle 16 fastened to the traverse 14, the nozzle 16 being operated with hot air and arranged to the side of the open shed 11. Furthermore, the weft picking device 7 is provided with a tube 17, lying below and extending over the entire width or breadth of the shed 11, the tube 17 carrying narrow strips 18, and wide strips 19. If the shed is opened, and the weaving lay 6 is in the weft picking position, the warp-threads 2 of the lower thread group lie between the reed strips 18, 19. The warp threads 3 of the upper thread groups are located out of contact with the reed strips 18, 19. In the case at hand, the strips of the reed are arranged so that one wide strip 19 follows every four narrow strips 18.

Figure 4:
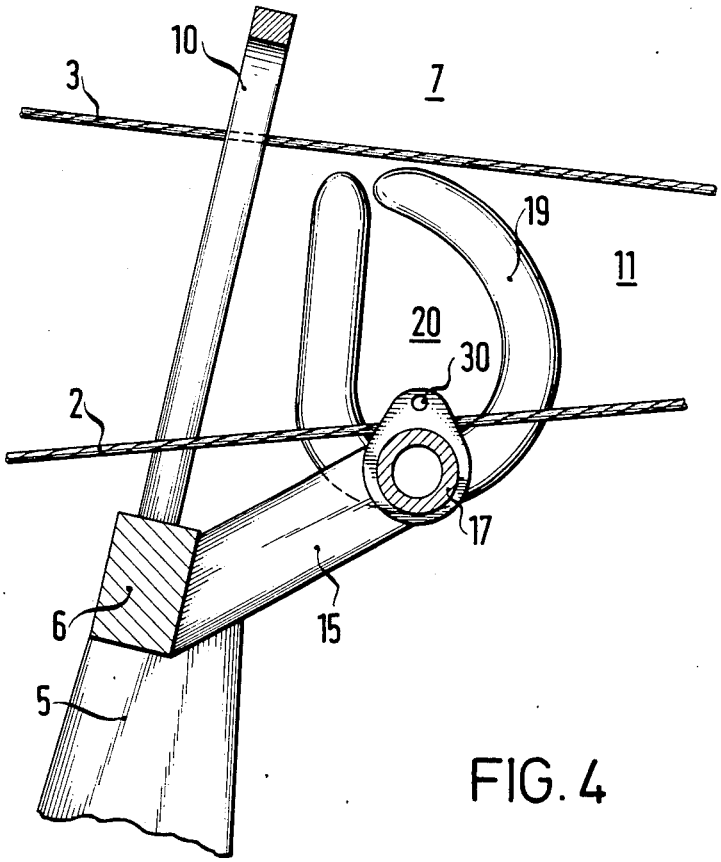
FIG. 4 is an enlarged fragmentary view of FIG. 1 showing the pneumatic weft insertion or picking device in greater detail.

Viewed from the side, the strips 18 and 19 have the same shape, as shown especially in FIG. 4. They have a pear shape with the interior thereof cut out and a slot at the top thereof, so that, in the weft insertion or picking position, as shown in FIG. 4, a channel 20 defined by the walls of the strips 18 and 19 is formed in the shed 11 for effecting the pneumatic weft picking.

Considered from a side view, the strips 18 and 19 according to FIGS. 1 and 4, have two upwardly directed legs of which the leg forwardly directed towards a contact edge 21 of the web 4 is clearly bent outwardly while the other leg extends more rectilinearly. FIG. 4 shows especially that the warp threads 2 lie on the tube 17, and accordingly are guided downwardly by the tube 17.

FIG. 2 shows that the weft insertion or picking nozzle 16 is connected with a hot air generator 27 via a flexible line 22, a control valve 24, and a heat-insulating pipeline 26 serving as an operative connection. In this application, the hot air generator 27 is constructed as an air compressor. The weft thread 28, coming from the top at the left-hand side of FIG. 2, enters through a side channel 29 into the weft insertion or picking nozzle 16 and, after the valve 24 has opened, is blown pneumatically by the hot air into the channel 20 defined by the strips 18 and 19 in the open shed 11. The insertion or picking of the weft is assisted or augmented by the feature that the guide elements or strips 19 are provided with carrier and acceleration nozzles 30 which are connected with the tube or pipe 17, and send out hot air flows 31, 32 in the direction of the weft.

After the weft has been inserted, the weaving lay 6 is moved into the contact position shown in phantom in FIG. 1, the lower warp threads 2 stripping the weft thread 28 out of the channel 20, whereafter it is entrained by the reed 10, and pushed to the contact edge 21 against the fabric 4. Thereafter, a new shed is formed by the alternating change in position of the heddles 12 and 13, and the operation of inserting or picking the weft is repeated. FIG. 2 shows that the tube 17 is connected via a flexible line 23, a control valve 25, and the hereinaforementioned heat insulated pipeline 26 to the same hot air generator 27.

FIG. 3 clearly shows in detail how the operative connection is constructed. The hot air inlet port 33 of the valve 24 and 25, respectively, is provided with a thread 34, which matches with the thread of a retaining nut 35. The operative connection 26 is provided with a pipeline 36 which has a beaded end and is heat-insulated by an insulating mantle or casing 37. The beaded end of the pipeline 36 is connected to the compressed air inlet port 33 through the intermediary of a sealing ring 38 with the aid of the retaining nut 35.

There is claimed:

1. Method of producing a textile web by pneumatic weft insertion which comprises generating a flow of hot air having a temperature of at least 45° C. and bringing a weft thread in contact with the flowing hot air during the insertion of the weft thread.

2. Method according to claim 1 which includes moving the weft thread by the flowing hot air into at least one shed formed by warp threads.

3. Method according to claim 1 which includes successively seizing, carrying and transporting a weft thread forward by a plurality of hot gas flows during the insertion of the weft thread.

4. Method according to claim 1 wherein the air is heated to at most 120° C.

5. Method according to claim 1 wherein the air is heated to a temperature of 60° to 80° C.

6. Device for producing a textile web by pneumatic weft insertion, comprising a weft insertion device, and a hot air generator connected to said weft insertion device for delivering thereto hot air having a temperature of at least 45° C.

7. Device according to claim 6 wherein said weft insertion device has at least one weft insertion nozzle operated with hot air and disposed at a side of at least one open shed.

8. Device according to claim 6 wherein a plurality of nozzles operated with hot air for performing at least one of the functions of pneumatically carrying and accelerating a weft thread in a forward transporting direction are disposed along at least one shed.

9. Device according to claim 6 wherein said hot air generator is constructed as an air compressor.

10. Device for producing a textile web by pneumatic weft insertion, comprising a weft insertion device, and a hot air generator formed as an air compressor and connected to said weft insertion device for delivering hot air thereto, said weft insertion device and said hot air generator being mutually connected by a heat-insulated pipeline.

* * * * *